United States Patent [19]

Thurmond, Jr.

[11] 4,169,313

[45] Oct. 2, 1979

[54] DRUM DEHEADER

[75] Inventor: Elmer T. Thurmond, Jr., Miami, Fla.

[73] Assignee: Equipment Company of America, Hialeah, Fla.

[21] Appl. No.: 902,480

[22] Filed: May 3, 1978

[51] Int. Cl.[2] ..... B67B 7/36

[52] U.S. Cl. ..... 30/432

[58] Field of Search ..... 30/400, 428, 429, 430, 30/431, 432, 442, 450

[56] References Cited

U.S. PATENT DOCUMENTS

| | | | |
|---|---|---|---|
| 333,764 | 1/1886 | Leopold | 30/432 |
| 583,999 | 6/1897 | Hurd | 30/432 |
| 1,052,297 | 2/1913 | Whitcomb | 30/432 |
| 1,492,855 | 5/1924 | Linn | 30/431 |
| 2,696,664 | 12/1954 | Chun | 30/431 |
| 3,088,203 | 5/1963 | Perl | 30/430 |
| 3,117,373 | 1/1964 | Wallace | 30/428 |

*Primary Examiner*—Gary L. Smith

*Attorney, Agent, or Firm*—Cullen, Sloman, Cantor, Grauer, Scott & Rutherford

[57] ABSTRACT

The drum deheader or cutter is for use in opening an end of a drum provided with a drum chime and comprises a base engageable with the outside surface of the drum, with the base having at one end an upstanding lug engageable with the top of the drum chime and having at the other end a shoulder engageable with the underside of the drum chime. A head is pivotally mounted on the base and is provided with an integral handle which extends in a direction away from said base and the drum. A blade is secured to the head for cutting the end of the drum adjacent the drum chime. An elongated operating lever is pivotally mounted on one end to the base and is connected to the head by a suitable linkage. A person may grip the handle with one hand and apply a force to the lever with the other hand thereby causing the head to pivot and the blade to be lowered into cutting engagement with the end of the drum. The blade is adjustable relative to the base to permit a close cut of drum along the drum chime regardless of the thickness of the drum chime that is between the blade and base.

16 Claims, 4 Drawing Figures

DRUM DEHEADER

BACKGROUND OF THE INVENTION

Steel drums are manufactured in two major types, the closed-head drum and the full-open-head drum with completely removable top head. The closed-head drum has top and bottom heads and a drum chime for each head, all sealed to the shell of shell of the drum by welding, typically. Drum chimes, which are the extended rims at the ends of the drum, assure tight construction and maintain continuous, consistent drum dimensions. Drum chimes vary in thickness depending on drum size or the intended use of the drum.

It is economically desirable to reuse the drums after they have been opened and the contents removed. Because of the various drum chime thicknesses, there exists a problem in opening the drums and still being able to closely cut along the side seam of the drum head so that little jagged edge extends into the shell exterior. If the cut is not made fairly close to the side seam of the drum head, then an additional operation is necessary to eliminate any jagged edges before the drum can be conditioned for reuse, not to mention the potential hazard to safety because of the jagged edges.

Prior art drum deheaders or cutters such as that shown in U.S. Pat. No. 3,117,373 are not intended for close side seam cuts regardless of the drum chime thickness.

SUMMARY OF THE PRESENT INVENTION

It is a feature of the present invention to provide a drum deheader or cutter that has an adjustable cutting blade to compensate for various drum chime thicknesses. A drum opened by the drum deheader of the present invention may be reconditioned and reused without the need for cutting away a dangerous jagged edge.

Another feature of the present invention is to provide a handle arrangement that efficiently and forcefully moves the cutting blade to cut.

Still another feature of the present invention is to provide a cutting blade that adds to the ease of cutting because of its design and its cutting motion.

A further feature of the present invention is to provide a drum cutter for use in opening an end of a drum provided with a drum chime which includes a base engageable with the outside surface of the drum, with the base having at one end an upstanding lug engageable with the top of the drum chime and having at the other end a shoulder engageable with the underside of the drum chime.

A still further feature of the present invention is to provide a drum cutter of the aforementioned type wherein a head is pivotally mounted on the base and is provided with an integral handle which extends in a direction away from the base and the drum, a blade secured to the head for cutting the end of the drum adjacent the drum chime, an elongated operating lever pivotally connected to the base, and a linkage system connecting the lever to the head whereby a person may grip the handle with one hand and apply a force to the lever with the other hand thereby causing the head to pivot and the blade to be lowered into cutting engagement with the end of the drum.

Another feature of the present invention is to provide a drum cutter or deheader which is simple in construction, economical to manufacture, easy to maintain and is efficient in operation.

For other objects and for a better understanding of the present invention, reference is made to the following detailed description of the invention in conjunction with the drawings.

DESCRIPTION OF A PREFERRED EMBODIMENT

Figure 1:
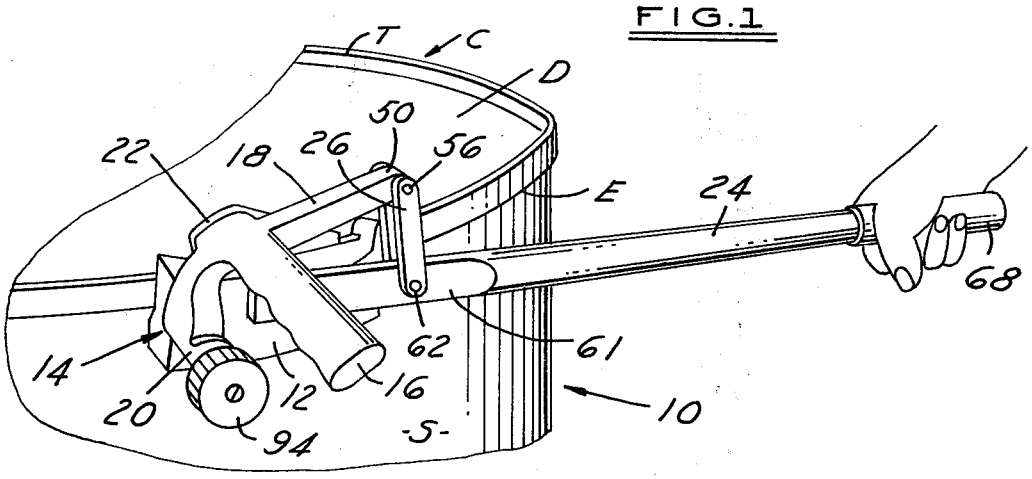
FIG. 1 shows the drum deheader or cutter of the present invention in working position on a typical steel drum.

The basic elements of the drum deheader or cutter 10 are illustrated in FIG. 1 in a cutting mode on a drum D. The cutter 10 comprises a base 12; a unitary head 14 pivotally mounted on base 12 and having integral components including a handle 16, a mounting lug 18 and an internally threaded collar or bracket 20; a cutting blade 22 secured to head 14; an elongated operating lever pivotally mounted on base 12; and a linkage system including a pair of links 26 which connect lever 24 to head 14.

Figure 2:
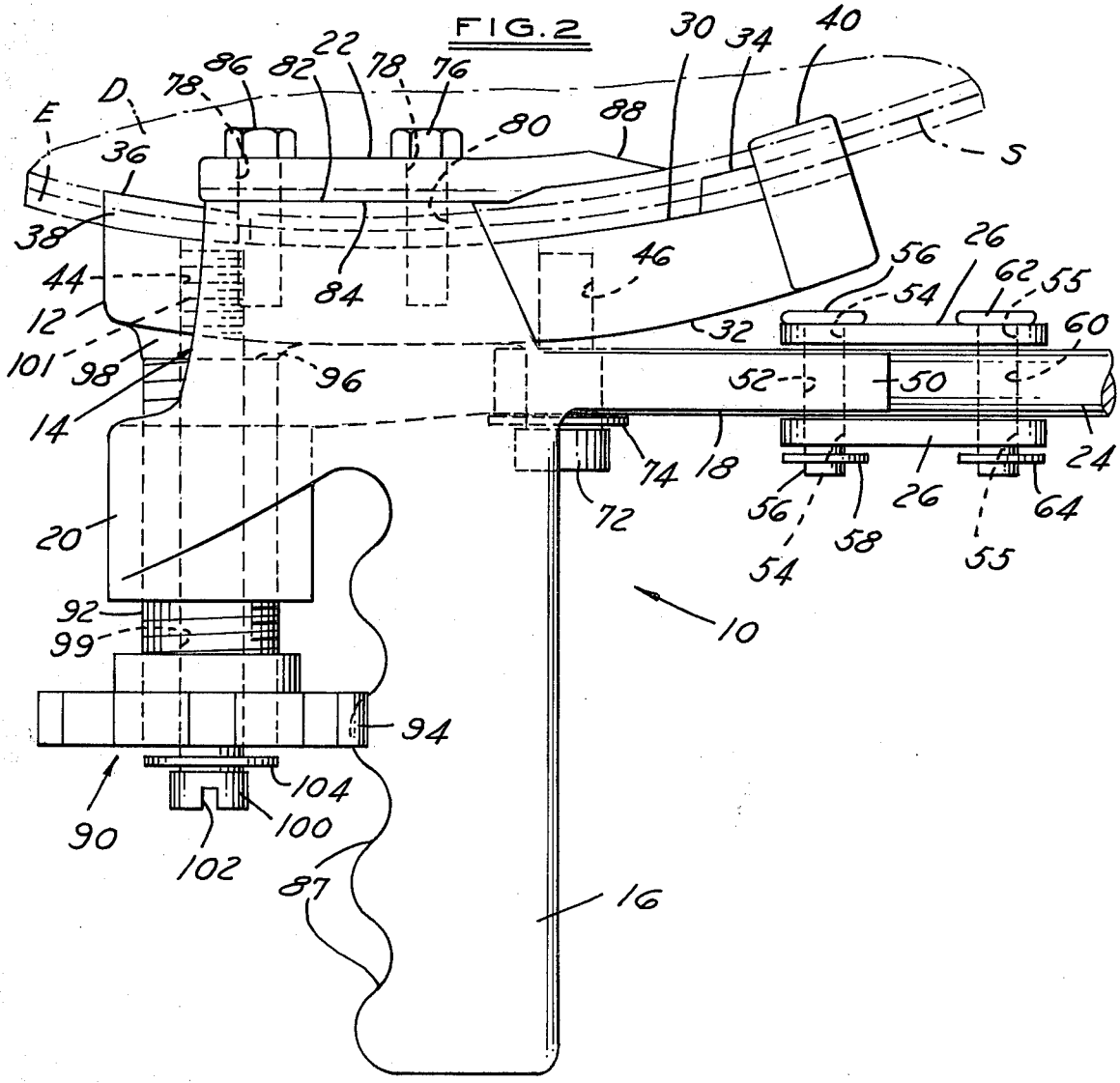
FIG. 2 is a top elevation view of the drum cutter.

The cutter base 12 is generally of curved or arcuate configuration as shown in FIG. 2 so that it may be applied to the outside cylindrical surface S of a drum D having a conventional upstanding rim or drum chime C. The base 12 has an inside curved surface 30 and an outside curved surface 32. The inside curved surface 30 has adjacent the rear and front ends thereof protruding drum contacting embossments or raised areas or portions 34 and 36 which contact the outside surface or wall S (FIG. 2). The remaining portion of surface 30 between the raised portions 34, 36 is spaced from the drum D. The raised area 36 at the front of the base 12 has a shoulder 38 which, when in use, is located on the drum D against the underside or edge E of the drum chime C.

The raised area 34 at the rear of the base 12 has an integral lug 40 with an inclined clamping surface 42 (FIG. 4) which engages or rides on the top surface T of the drum chime C.

Figure 4:
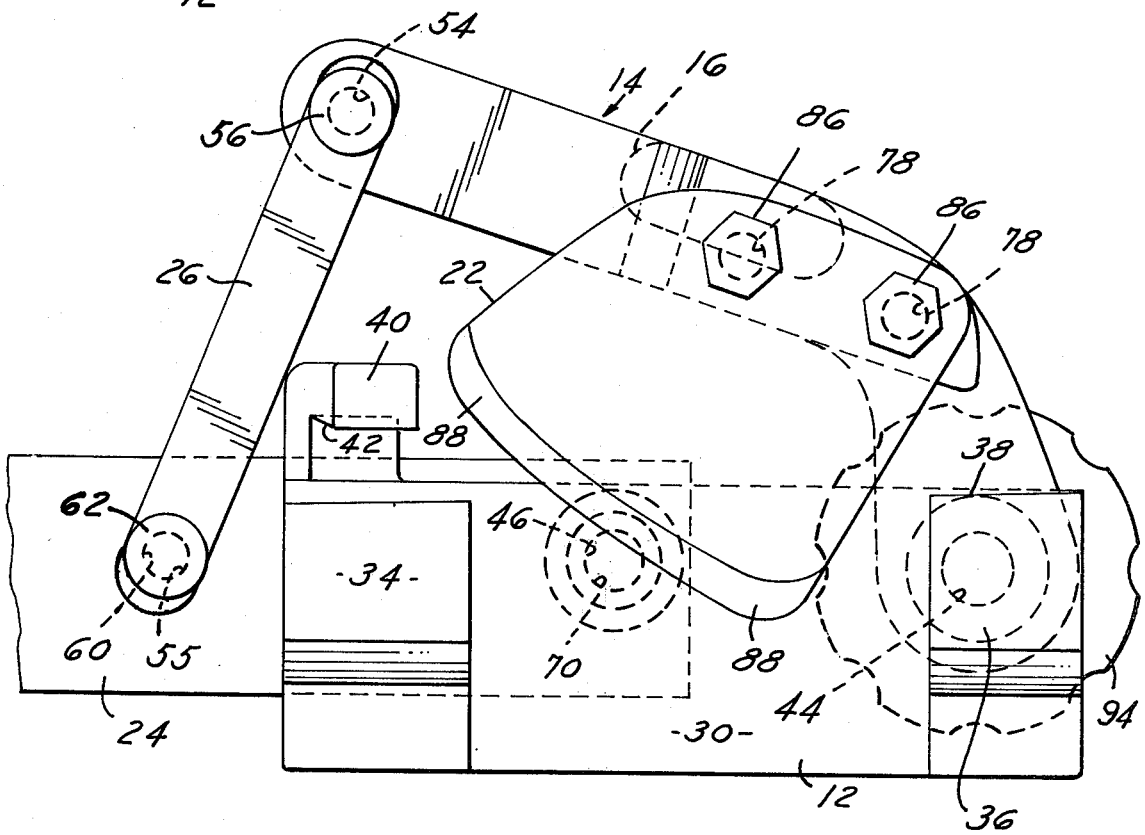
FIG. 4 is a side elevation view of the drum cutter.

The cutter base 12 has a pair of internally threaded openings 44 and 46 which extend completely through the base 12 from the inside surface 30 to the outside surface 32. The openings 44 and 46 each have an axis which is parallel to the other axis. Such axes lie in a horizontal plane which is spaced below shoulder 38 and lug 40 as shown in FIG. 4. Such openings 44, 46 receive axially extending pivot means or connections for mounting the head 14 and lever 24 respectively.

The integral mounting lug 18 of head 14 is elongated and of generally rectangular cross-section. It overlies the lever 24 as shown in FIG. 1. The outer end 50 of the lug 18 is provided with a hole 52 (FIG. 2). Each link 26 has a pair of holes 54, 55 at opposite ends. The links 26 are located on opposite sides of lug 18, with holes 52 and 54 aligned. An upper pivot pin 56 is inserted in the holes of the aligned lug 18 and links 26. The pin 56 may be retained in assembled relationship by means of a conventional spring ring 58.

Following through with links 26, it will be noted in FIGS. 1, 2 and 4 that the lower ends thereof are located on opposite sides of the elongated lever 24 which has a through hole 60. The lever 24 is generally tubular except at the inner end portion thereof where it is flattened as shown by numeral 61 in FIGS. 1 and 3. A second pivot pin 62 is located through the aligned openings 55 and 60 of the links 26 and lever 24. The pin 62 is retained assembled by means of a conventional spring ring 64 (FIG. 2).

The elongated lever 24 has on the outer end a vinyl hand grip 68 which a person grips when operating the cutter 10. Besides the aforementioned opening or hole 60, the lever 24 has a second opening or hole 70 near the inner end thereof (remote from hand grip 68) which overlies the threaded hole 46 of the base 12 as shown in FIG. 2. A bolt 72 with washer 74 pivotally connects the inner end of lever 24 to the base 12.

The unitary head 14 also serves the additional function of mounting the base 22 thereon. The blade 22 is provided with a pair of openings 78 which overlie threaded openings 80 provided in the generally flat surface 82 of head 14. The blade 22 has a flat surface 84 which abuts head surface 82. A pair of removable set screws 86 secure cutter blade 22 to the head 14 with surfaces 82 and 84 in engagement as shown in FIG. 2. The blade 22 has a cutting edge 80.

The handle 16 of base 14 is generally perpendicular to lever 24. It is elongated and has a series of protuberances or knobs 87 (FIG. 2) along one edge thereof forming a hand grip.

As noted previously the operating lever 24 is connected firstly to head 14 via links 26 and secondly to the base 12 via the bolt or pivot 72. The blade 22 is fixedly connected to the head 14 by set screws 86. The head 14 is pivotally connected to the base 12 through the novel pivot and adjustment means 90 which permit the head 14 to pivot on the base 12 and to be adjusted to fit various chime (rim) thicknesses. Thus dimension "d" shown in FIG. 3 may be altered to compensate for drum chimes of various thicknesses.

The pivot and adjustment means 90 comprises a tubular adjustment screw 92 having on the outer end a knob 94 to facilitate turning same to vary the spacing "d" between the blade 22 and the base 12. The inner end of screw 92 has an abutment surface 96 which engages a raised zone 98 on base 12. The screw 92 is externally threaded from one end to the other for threaded engagement with the internally threaded collar or bracket 20 provided as an integral part of head 14. The inside bore 99 of screw 92 is unthreaded.

Figure 3:
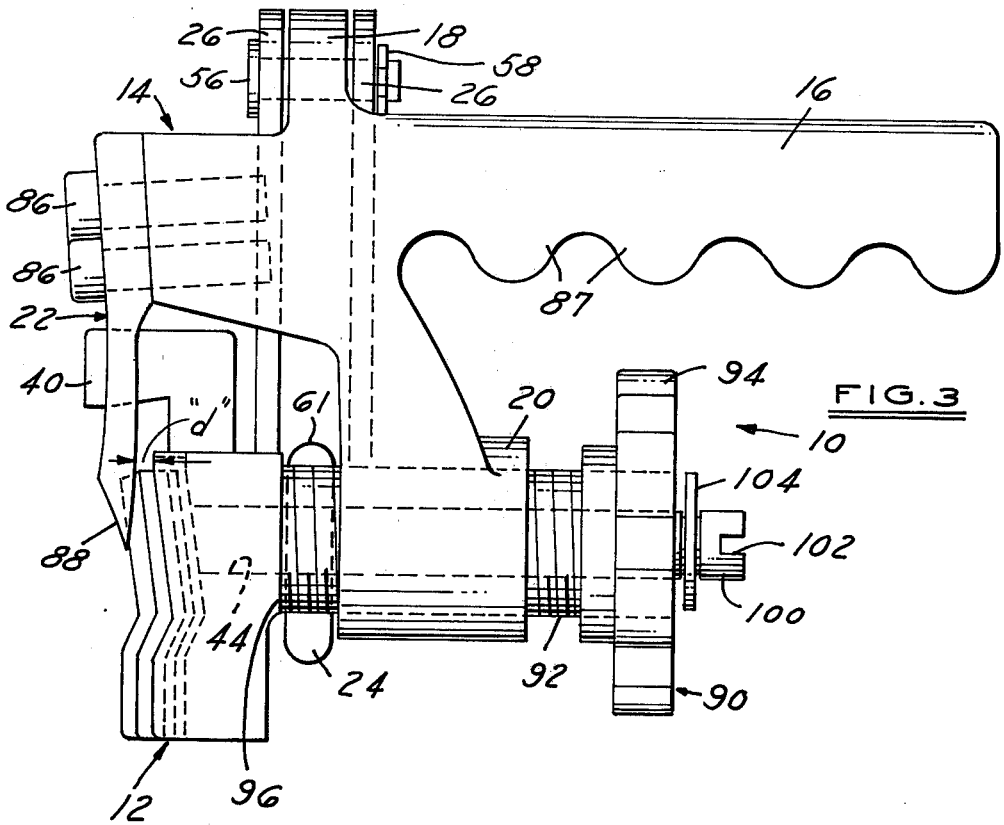
FIG. 3 is a front elevation view of the drum cutter.

After the tubular adjustment screw 92 is inserted into the threaded collar 20 as illustrated in FIGS. 2 and 3, an adjustment screw shaft 100 having a length greater than the length of the adjustment screw 90 is inserted through the adjustment screw 92 and is threaded into the threaded opening 44 in the base 12. Only the inner end 101 of shaft 100 is threaded. The remaining portion of a shaft 100 is smooth and is not threaded. The outer end of shaft 100 has a tool engaging slot 102 and the shaft 100 is provided with a washer or ring 104 (FIGS. 2 and 3).

It is possible to adjust the screw 92 as required to bring the cutter base 12 in contact with the outer surface S of the drum D and the blade 22 in contact with the inside edge of the chime C. It is also possible to back off or to rotate the knob 94 counterclockwise so that the blade 22 does not bind and wedge the drum chime C between the blade 22 and the cutter base 12. Relative rotation of the adjustment screw 92 and head 14 moves the head 14 with respect to base 12 to vary the spacing "d" between the blade 22 and the base 12 to conform to various drum chime thicknesses.

The drum deheader or cutter 10 as indicated previously is designed to be used on drums of various sizes and with various chime thicknesses. Thus, for proper operation the drum deheader or cutter 10 must be adjusted to fit the particular drum with which it is being used. Initially, the deheader or tool 10 is applied to the drum and at such time the handle 24 is pointing generally straight upwardly or in other words approximately ninety degrees from the position illustrated in FIG. 1. Thereafter, the operator backs off the adjustment knob 94 and extends the tool or deheader 10 to its fully open position so as to provide for maximum blade clearance with the drum. In other words, the blade 22 will be spaced from and out of contact with the drum D. Thereafter, the deheader 10 is tilted away from the user and the lug 40 provided at the rear of the cutter base 12 is placed on top surface T of the drum chime C. At such time the lever 24 is pointing upwardly and inwardly from the mechanic. Thereafter the lever 24 is lowered until the blade 22 and in particular its cutting edge 88 is in contact with the drum head D adjacent the chime C. The shoulder 28 at the front of the cutter base 12 is against the underside or edge E of the drum chime C and the lug 40 is resting on top of the chime C. When properly positioned, the drum deheader or cutter 10 will rest on the drum without support.

The adjustment means 90 is adjusted as required to bring the cutter base 12 in contact with the side S of the drum D and the blade 22 in contact with the inside edge of the chime C. The operator can back off the adjustment knob 90 slightly so that the blade 22 does not bind and wedge drum chime C between the blade 22 and the cutter base 12.

To begin cutting, the operator or mechanic presses the lever 24 downwardly from the position shown in FIG. 1 until the cutting edge of the blade 22 punctures the drum head. Thereafter, the lever 24 is raised and the deheader or tool 10 is slid backwardly for the next cutting operation. It has been found that the greater each cut is overlapped, the smoother the edge will be.

It is recommended that the cutting blade screws be kept tight to obtain a clean, even cut, and to prevent damage to the deheader 10. It is also recommended that the user lubricate the pivot points and adjusting screw periodically with light machine oil.

The pivot and adjustment means 90 and the pivot or bolt 70 each have an axis which is parallel to the other. Such axes are in the same horizontal plane located below lug 40 and shoulder 38.

What is claimed is:

1. A drum cutter for use in opening an end of a drum provided with a drum chime comprising a base engageable with the outside surface of the drum, said base having at one end an upstanding lug engageable with the top of the drum chime and having at the other end a shoulder engageable with the underside of the drum chime, a head provided with an integral handle which extends in a direction away from said base and the drum, pivot means having a first axis for mounting said head on said base, a blade secured to said head for cutting the end of the drum adjacent the drum chime, an elongated operating lever pivotally mounted on one end to said base about a second axis and linkage means connecting an intermediate portion of said lever to said head whereby a person may grip the handle with one hand and apply a force to said lever with the other hand thereby causing said head to pivot and said blade to be lowered into cutting engagement with the end of the drum, said handle and said lever being generally perpendicular, said handle being elongated and having a series of protuberances along one edge thereof forming a hand grip, and said blade being removably secured to said head by set screws and being located in a plane which is generally perpendicular to said handle.

2. The drum cutter defined in claim 1 wherein the inner surface of said base at the opposite ends thereof is provided with raised surface portions which are adapted to engage the outside surface of the drum, with the portion of the inner surface between said raised surface portions being spaced from the drum.

3. The drum cutter defined in claim 2 wherein said head has an integral mounting lug extending generally perpendicular to said handle and being spaced above said lever, said linkage means including a pair of links, said lug being located between the upper ends of said links and said lever being located between the lower ends of said links, and upper and lower pivot pins carried by said links and extending through said lug and lever respectively.

4. A drum cutter for use in opening an end of a drum provided with a drum chime comprising a base engageable with the outside surface of the drum, said base having at one end an upstanding lug engageable with the top of the drum chime and having at the other end a shoulder engageable with the underside of the drum chime, a head provided with an integral handle which extends in a direction away from said base and the drum, pivot means having a first axis for mounting said head on said base, a blade secured to said head for cutting the end of the drum adjacent the drum chime, an elongated operating lever pivotally mounted on one end to said base about a second axis and linkage means connecting an intermediate portion of said lever to said head whereby a person may grip the handle with one hand and apply a force to said lever with the other hand thereby causing said head to pivot and said blade to be lowered into cutting engagement with the end of the drum, said pivot means including an adjustment screw threadedly carried by said head, said adjustment screw having on one end an abutment surface engageable with said base whereby relative rotation of said adjustment screw and said head moves said head with respect to said base to vary the spacing between said blade and said base to conform to various drum chime thicknesses.

5. The drum cutter defined in claim 4 wherein said adjustment screw is tubular and is provided with threads on the exterior thereof which threadedly engage said head, said pivot means including a shaft which extends through said screw and having one end thereof threadedly carried by said base, said shaft having a length greater than the length of said screw and having means on the other end thereof for retaining said screw on said shaft.

6. The drum cutter defined in claim 5 wherein said other end of said shaft is provided with a slot for receiving a tool for adjustably threading same into and out of said base.

7. The drum cutter defined in claim 5 wherein the other end of said adjustment screw opposite said abutment surface is provided with a knob to facilitate turning same to varying the spacing between said blade and said base.

8. The drum cutter defined in claim 4 wherein said handle and said lever are generally perpendicular.

9. The drum cutter defined in claim 4 wherein said handle is elongated and has a series of protuberances along one edge thereof forming a hand grip.

10. The drum cutter defined in claim 4 wherein the inner surface of said base at the opposite ends thereof is provided with raised surface portions which are adapted to engage the outside surface of the drum, with the portion of the inner surface between said raised surface portions being spaced from the drum.

11. The drum cutter defined in claim 4 wherein said blade is removably secured to said head by set screws and is located in a plane which is generally perpendicular to said handle.

12. The drum cutter defined in claim 4 wherein said head has an internally threaded collar through which said pivot means and said adjustment screw extend.

13. The drum cutter defined in claim 4 wherein said first and second axes are parallel and said base is arcuate to conform to the drum.

14. The drum cutter defined in claim 4 wherein said first and second axes are located in a horizontal plane.

15. The drum cutter defined in claim 14 wherein said first and second axes are located below said shoulder and said lug of said base.

16. The drum cutter defined in claim 4 wherein said head has an integral mounting lug extending generally perpendicular to said handle and being spaced above said lever, said linkage means including a pair of links, said lug being located between the upper ends of said links and said lever being located between the lower ends of said links, and upper and lower pivot pins carried by said links and extending through said lug and lever respectively.

* * * * *